US008608674B2

(12) United States Patent
Krebs et al.

(10) Patent No.: US 8,608,674 B2
(45) Date of Patent: Dec. 17, 2013

(54) PELVIS INTERFACE

(75) Inventors: Hermano I. Krebs, Cambridge, MA (US); Neville Hogan, Sudbury, MA (US); Michael Roberts, Cambridge, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 1107 days.

(21) Appl. No.: 12/498,792

(22) Filed: Jul. 7, 2009

(65) Prior Publication Data

US 2010/0152627 A1 Jun. 17, 2010

Related U.S. Application Data

(63) Continuation of application No. 11/750,324, filed on May 17, 2007, now Pat. No. 7,556,606.

(60) Provisional application No. 60/747,587, filed on May 18, 2006.

(51) Int. Cl.
*A61H 1/00* (2006.01)

(52) U.S. Cl.
USPC ..... 601/5; 601/24

(58) Field of Classification Search
USPC ..... 601/5, 23, 24, 26, 27, 33, 34, 35; 482/69
See application file for complete search history.

(56) References Cited

U.S. PATENT DOCUMENTS

| | | | |
|---|---|---|---|
| 329,653 | A | 11/1885 | Kitchen |
| 2,109,188 | A | 2/1938 | Bajanova |
| 5,997,444 | A | 12/1999 | McBride |
| 6,464,652 | B1 | 10/2002 | Hubbard et al. |
| 6,669,605 | B2 | 12/2003 | Scates |
| 6,689,075 | B2 | 2/2004 | West |
| 6,821,233 | B1 | 11/2004 | Colombo et al. |
| 7,125,338 | B2 | 10/2006 | Silverbrook |
| 2003/0004444 | A1 | 1/2003 | Perner et al. |
| 2004/0116839 | A1 | 6/2004 | Sarkodie-Gyan |
| 2005/0288157 | A1 | 12/2005 | Santos-Munne et al. |
| 2007/0016116 | A1 | 1/2007 | Reinkensmeyer et al. |

*Primary Examiner* — Quang D Thanh
(74) *Attorney, Agent, or Firm* — Peter K. Sollins; Foley Hoag LLP

(57) ABSTRACT

A pelvis interface may include a subject attachment module including a waist attachment and a back attachment. The interface may further include an arm assembly coupled to the subject attachment module, the arm assembly including a plurality of arms so coupled to one another and/or to the subject attachment module as to permit the subject attachment module at least one pelvis translation degree of freedom and at least one pelvis rotation degree of freedom. The interface may further include motors so coupled to the arm assembly as to actuate at least one pelvis translation degree of freedom and at least one pelvis rotation degree of freedom.

51 Claims, 18 Drawing Sheets

PELVIS INTERFACE

CROSS-REFERENCE TO RELATED APPLICATIONS

This application is a continuation of U.S. application Ser. No. 11/750,324, filed May 17, 2007, now U.S. Pat. No. 7,556,606, which claims the benefit of U.S. Provisional Application Ser. No. 60/747,587, filed May 18, 2006.

BACKGROUND

Neurological trauma, orthopedic injury, and joint diseases are common medical problems in the United States. A person with one or more of these disorders may lose motor control of one or more body parts, depending on the location and severity of the injury. Recovery from motor loss frequently takes months or years, as the body repairs affected tissue or as the brain reorganizes itself. Physical therapy can improve the strength and accuracy of restored motor function and can also help stimulate brain reorganization. This physical therapy generally involves one-on-one attention from a therapist who assists and encourages the patient through a number of repetitive exercises. The repetitive nature of therapy makes it amenable to administration by properly designed robots.

SUMMARY

This disclosure describes robotic pelvis interfaces that may support therapy by guiding, assisting, resisting, and/or perturbing pelvis motion.

A pelvis interface may include a subject attachment module including a waist attachment and a back attachment. The interface may further include an arm assembly coupled to the subject attachment module, the arm assembly including a plurality of arms so coupled to one another and/or to the subject attachment module as to permit the subject attachment module, relative to the pelvis interface, at least one pelvis translation degree of freedom and at least one pelvis rotation degree of freedom. The interface may further include motors so coupled to the arm assembly as to actuate the subject attachment module relative to the pelvis interface in at least one pelvis translation degree of freedom and at least one pelvis rotation degree of freedom.

DETAILED DESCRIPTION

Figure 1:
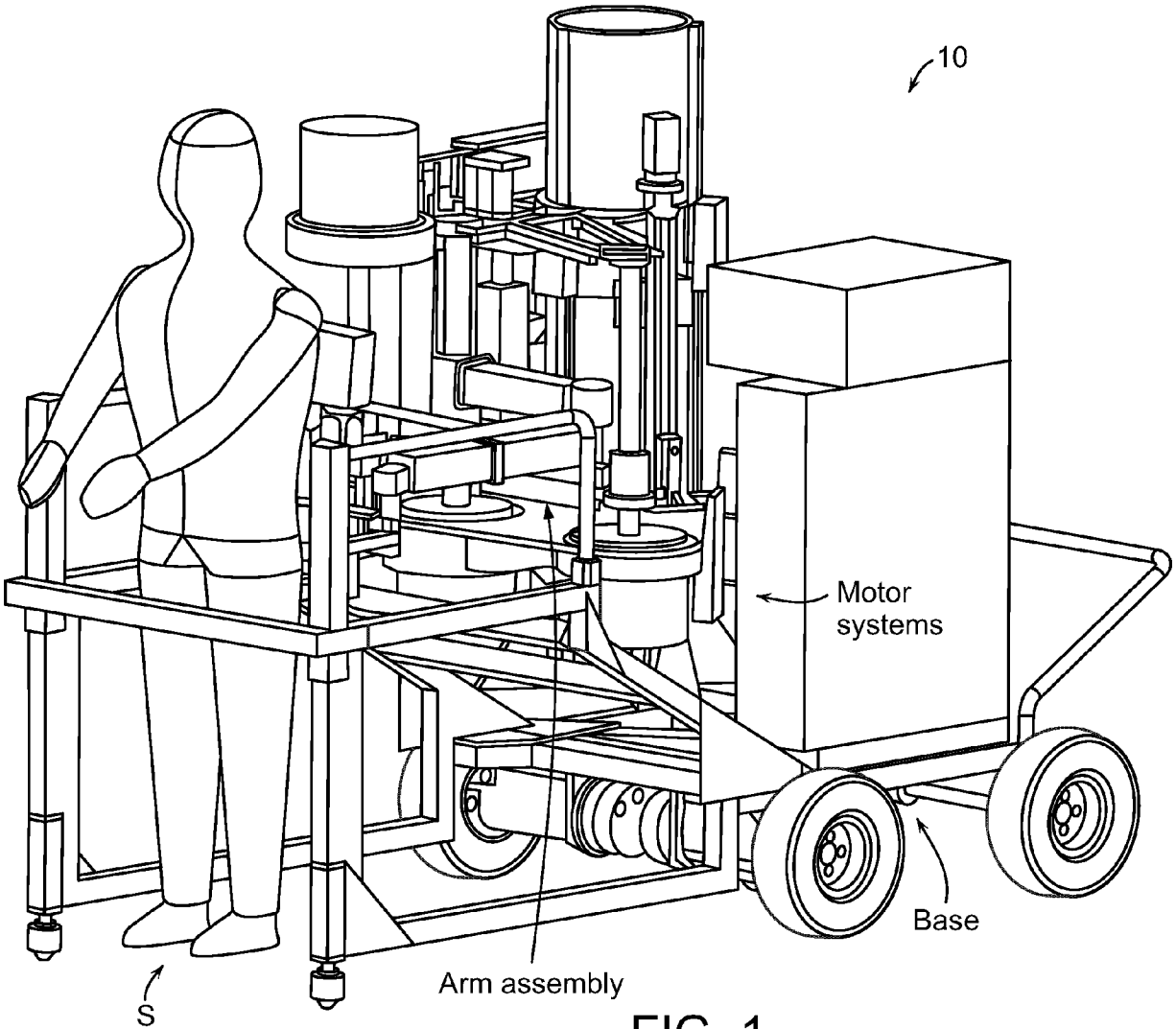
FIG. 1 depicts one exemplary embodiment of a pelvis interface.

The pelvis interfaces described herein can be used to provide physical and/or occupational therapy to a subject. In particular, the pelvis interface includes a series of motors that can apply translation forces and/or rotation torques to a pelvis. In some modes of operation, a pelvis interface can deliver assistance forces and/or torques to a subject (i.e., forces/torques that assist a subject in moving the pelvis in the desired way). In other modes, a pelvis interface can deliver resistance forces and/or torques (i.e., forces/torques that oppose a desired motion, as a way of building strength) or perturbation forces/torques (i.e., forces/torques that are oblique—such as perpendicular or substantially perpendicular—to a desired motion, as a way of building accuracy or to facilitate quantitative study of posture, balance and locomotor behavior of unimpaired subjects and quantitative assessment of sensory and motor impairment of posture, balance and locomotion in persons recovering from neurological and orthopedic injury).

The pelvis interface may provide an interactive experience to the subject using the device. To afford this interactive behavior the device should respond to forces from (or motions of) its environment faster than that environment, in this case the human, may generate them. The speed at which the device is able to respond and execute changes may be characterized by its interaction bandwidth. To be interactive, the pelvis interface should have an interaction bandwidth higher than its human subject. Maximum human response bandwidth is estimated at 15 Hz (that is, a human is estimated to be capable of performing a repetitive motion at a maximum frequency of 15 times per second). The bandwidth for pelvic motions may be considerably lower, such as 10 Hz, 5 Hz, 2 Hz, or 1 Hz. The device should also have low friction and low inertia at the interaction port (collectively, "low impedance") to allow the subject to push the device out of the way as needed. Put another way, the device should be sufficiently responsive and should offer sufficiently little resistance to the subject's motion so that the subject feels substantially as if moving while attached to the device is no different from moving through free air. A device with medium or high impedance may give the subject the typically undesired sensation of pushing the device through water or other viscid material or being unable to move the device at all. Frail or weak subjects, such as rehabilitation subjects, may be especially vulnerable to detrimental consequences of such sensations.

To be sufficiently robust to provide body-weight support the pelvis interface may be large and heavy. Consequently, it may be difficult to achieve an interaction bandwidth sufficient to provide an adequate approximation of the "free air" sensation to the user if the entire mass of the pelvis interface must be moved. To permit a higher interaction bandwidth than the subject, as well as low apparent friction and low apparent inertia at the interaction port, the pelvis interface may have a modular configuration that includes a backdriveable low impedance robot (which provides interaction bandwidth higher than the subject, low friction, and low inertia) to manipulate the pelvis (in translation and rotation) and which is coupled to or mounted on a non-backdriveable system that provides propulsion and body-weight support without requiring excessive weight or cost (hence with interaction bandwidth smaller than the human, high friction, and high inertia). In the present disclosure, the arm assembly serves as the backdriveable low impedance robot. The arm assembly is coupled to nonbackdriveable systems providing propulsion, body weight support, and/or height adjustment.

Normal pelvic motion involves movements in several degrees of freedom, including three translational and three rotational degrees of freedom. The three translational degrees of freedom include vertical translation (up-and-down motion of the pelvis), lateral or left-right translation (weight shift towards the stance leg that allows the swing leg to be lifted), and frontal or anterior/posterior translation (average forward displacement).

Figure 2:
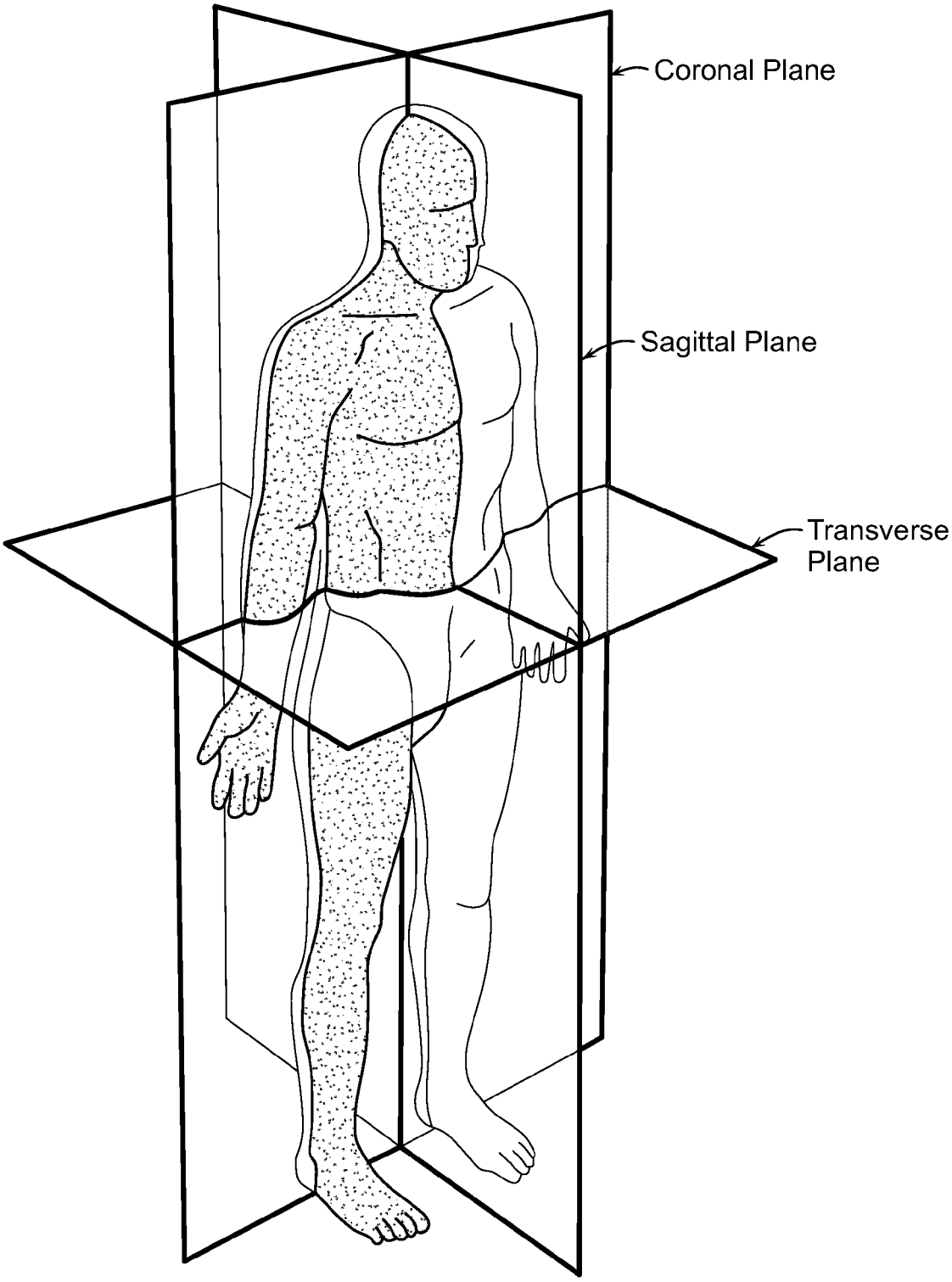
FIG. 2 depicts a human silhouette and reference planes.

FIG. 2 schematically depicts a human subject and shows the three planes in which rotation is defined: transverse, coronal, and sagittal. "Transverse" rotation (or "yaw") means rotation in the transverse plane or a plane parallel to it; in the context of pelvis motion, transverse rotation refers to the moving of one hip forward or backward of the other. "Coronal" rotation (or "roll") refers to the raising of one hip relative to the other, and "sagittal" rotation (or "pitch") refers to tilting the top of the pelvis forward or backward of the bottom of the pelvis.

The pelvis interfaces described herein permit motion of a subject's pelvis in each or a subset of these degrees of freedom in order to permit recapitulation of normal pelvic motion. In some embodiments, a pelvis interface provides the six degrees of freedom listed above. In some embodiments, a pelvis interface need not provide the sagittal rotation and/or coronal rotation degrees of freedom, because these degrees of freedom contribute relatively little to normal pelvic motion and gait.

The pelvis interface motors may actuate all or a subset of the provided degrees of freedom. For example, while a pelvis interface may provide four or more degrees of freedom (three translation plus transverse rotation, with sagittal and coronal rotation optional), it may actuate fewer than all of the provided degrees of freedom with motors; this may be sufficient to train or rehabilitate pelvis gait, as the contribution to motion in the sagittal and coronal rotation degrees of freedom is small compared to that in the actuated degrees of freedom.

A controller, such as a programmed computer, may direct the actuation of various motors to execute a rehabilitation or training program. A pelvis interface can be combined with an ankle interface (such as described in U.S. patent application Ser. No. 11/236,470, which is hereby incorporated herein by this reference) in order to provide coordinated therapy for a subject's lower extremity.

The disclosed interfaces can also be used to correlate pelvic motion to brain activity and/or to muscle activity, to study posture, balance, locomotion and/or pelvic movement control in unimpaired subjects and in persons recovering from neurological and orthopedic injury. Pelvic motion measurement may be correlated to brain and/or muscle activity measurements obtained through a variety of modalities, such as electroencephalography (EEG), electromyography (EMG), magnetic resonance imaging (MRI), functional MRI (fMRI), computed tomography (CT), positron emission tomography (PET), among others. The disclosed interfaces may also be used as telerobotic interfaces and as general interfaces for interpreting pelvis movement.

The disclosed interfaces may also be used in various combination therapies. Motor therapy with a pelvis interface may be combined with various therapeutic substances (described below); such combinations may be additive or synergistic in effect. Of particular interest for treatment of spinal cord injury may be a combination of pelvis interface therapy with pharmaceutical therapy. Another is with cellular therapy, such as with an olfactory ensheathing glial cell graft. Yet another is with molecular therapy, such as with myelin associated protein inhibitors. These applications are described in greater detail below.

FIG. 1 shows one exemplary embodiment of a pelvis interface 10. The depicted embodiment includes several components that will be described in detail below. It should be noted that while some figures depict pelvis interfaces having several components in common, it is not necessary that all embodiments include all components shown. Rather, components are depicted in combination to show how such components may interact with one another.

FIG. 1 depicts a subject S positioned in relation to the exemplary pelvis interface. The interface includes a subject attachment module (obscured by subject S), an arm assembly coupled to the subject attachment module, and a motor system coupled to the arm assembly. The interface may also include a base, motorized or not, a handrail and gate, and various other components.

Figure 3:
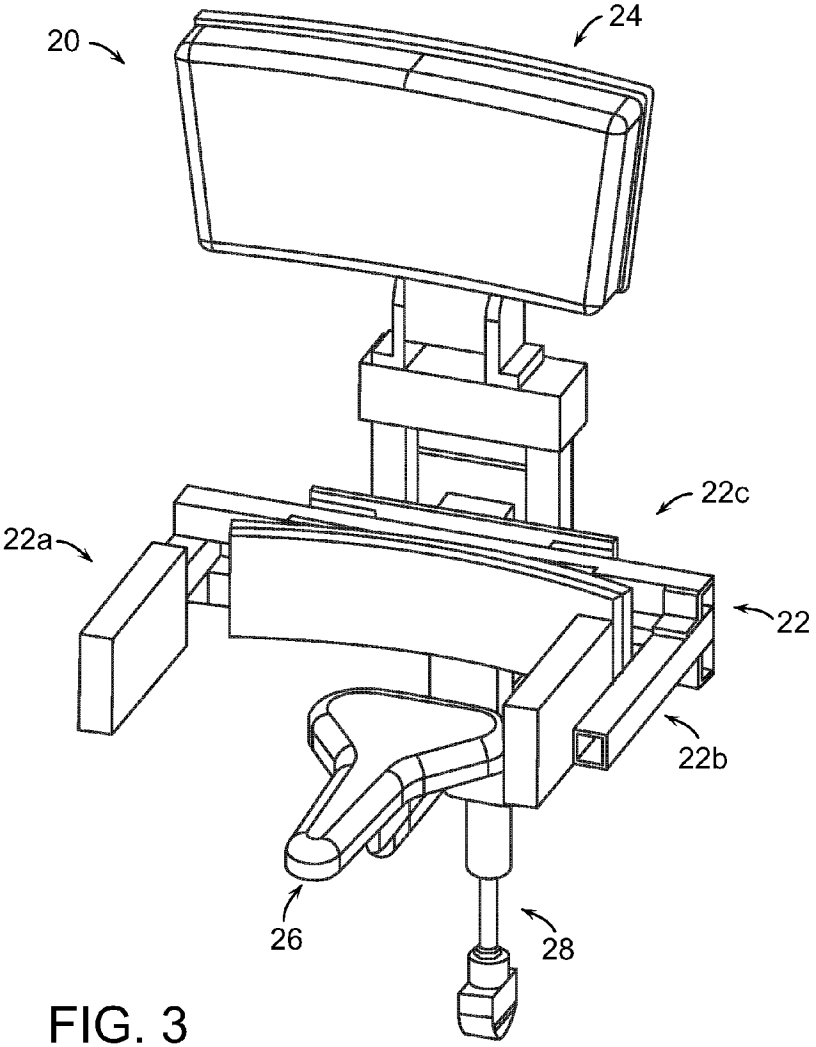
FIG. 3 depicts one exemplary embodiment of a subject attachment module.

FIG. 3 depicts a subject attachment module 20. The subject attachment module may include a waist attachment 22, a back attachment 24, and a seat 26. A subject contacting the subject attachment module may straddle the seat so that the seat supports the pelvis from below. The waist attachment may include side portions 22*a*, 22*b* that contact the subject's waist on the sides, and a rear portion 22*c* that contacts the subject's waist from the rear. The waist attachment may also include a waist belt (not shown) that encloses the subject in the front. The subject attachment module may also include a damper 28, which is described elsewhere.

Figure 4:
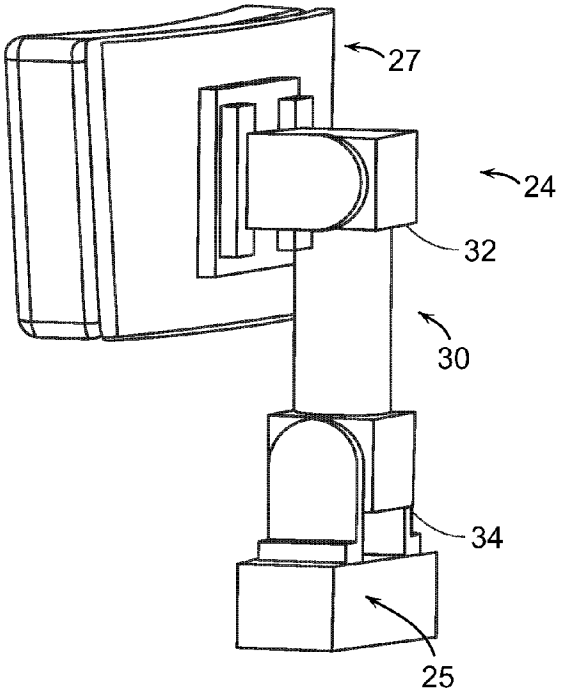
FIG. 4 depicts a rear view of one exemplary embodiment of a back attachment.

FIG. 4 depicts a rear view of an exemplary embodiment of a back attachment 24 that includes base 25 and backrest 27. The back attachment may be attached to the waist attachment at base 25. The back attachment may include an arm 30 that extends from base joint 34 to backrest joint 32. The backrest couples to the arm 30 at the backrest joint. The arm 30 and joints may provide two rotational and one translational (telescopic arm) degrees of freedom for adjusting the back attachment to suit a particular subject.

Figure 5B:
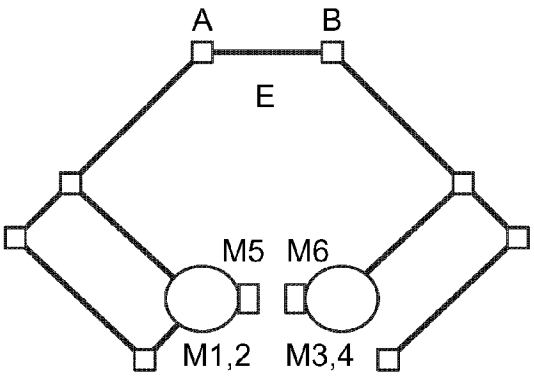
FIGS. 5, 5A, and 5B depict schematic linkage diagrams for exemplary embodiments of arm assemblies.
Figure 5A:
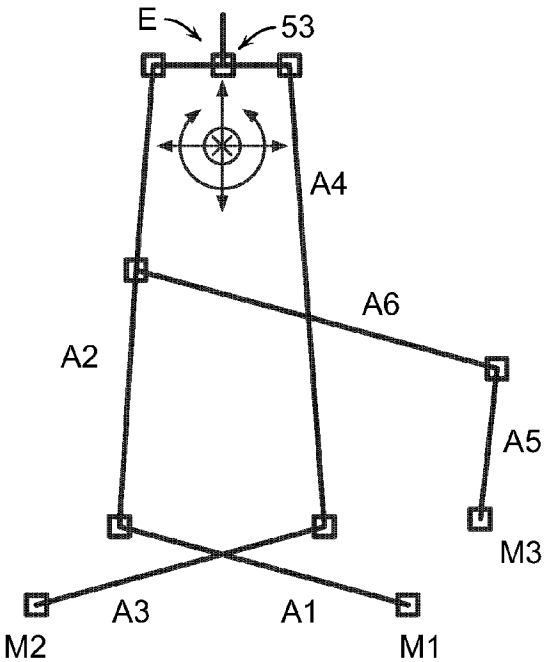
Figure 5:
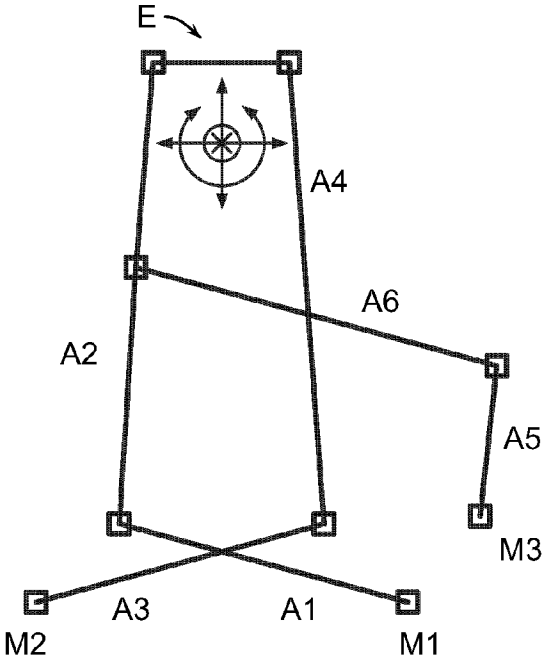

FIG. 5 shows a schematic depiction of an arm assembly. The depicted assembly includes six arms A1, A2, A3, A4, A5, and A6. The arms are so coupled to one another and/or to the subject attachment module as to permit four degrees of freedom to the endpoint E: x- and y-translation in the plane of the paper, yaw (transverse, twist) rotation about an axis perpendicular to that plane (represented as ⊗ in FIG. 5, and roll (coronal) rotation about a forward-backward axis. The arm mechanism may be coupled to the endpoint through a rotary bearing 53 (FIG. 5A) that permits coronal rotation. This bearing may be actuated by an additional motor (not shown) in order to actuate coronal rotation. Three motors, M1, M2, and M3, may be coupled to certain arms so as to provide actuation for three of these degrees of freedom. As discussed above, the coronal degree of freedom in some embodiments is not actuated.

FIG. 5B depicts an embodiment of an arm assembly that can provide and/or actuate at least three pelvis translation degrees of freedom and two pelvis rotation degrees of freedom, transverse and coronal. Points A and B of endpoint E are each coupled to respective arm subassemblies. The arm subassemblies each provide two planar translation degrees of freedom; these degrees of freedom may be actuated by motors M1,2 and M3,4, respectively. The arm subassemblies may also be coupled to vertical motors M5, M6, respectively to actuate a vertical translation degree of freedom for each subassembly. This arrangement of arm subassemblies provides the at least five degrees of freedom. Actuation of the various motors of the subassemblies can be coordinated to actuate the five degrees of freedom. For example, coronal rotation may be actuated by changing the relative heights of points A and B.

Figure 7:
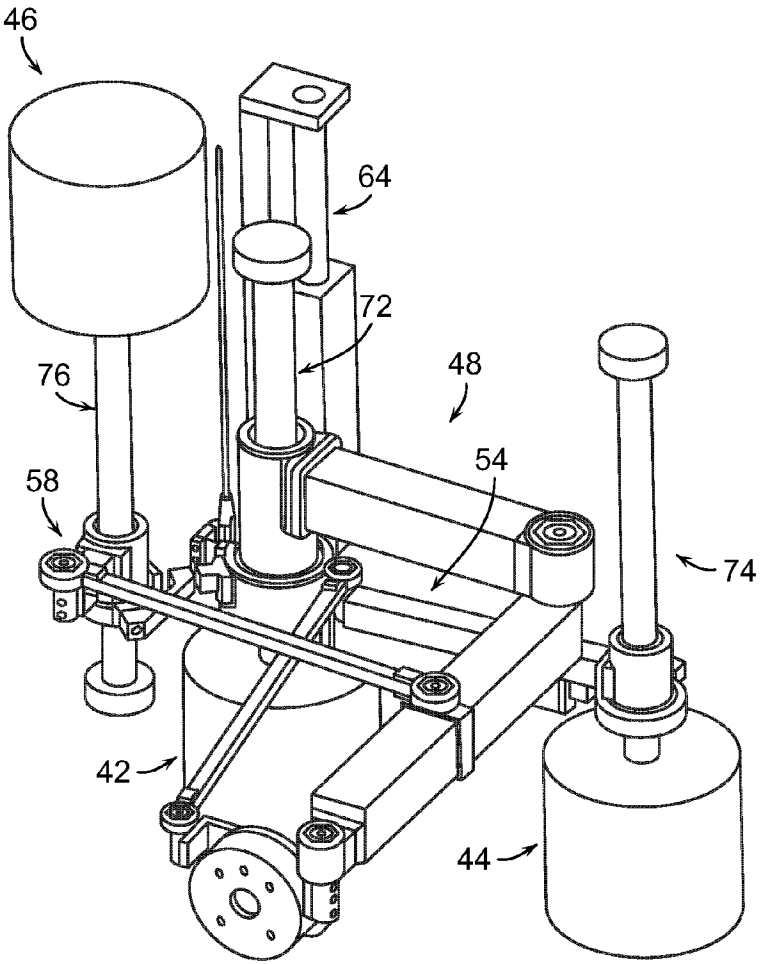
FIG. 7 depicts a perspective view of the arm assembly of FIG. 5.
Figure 6:
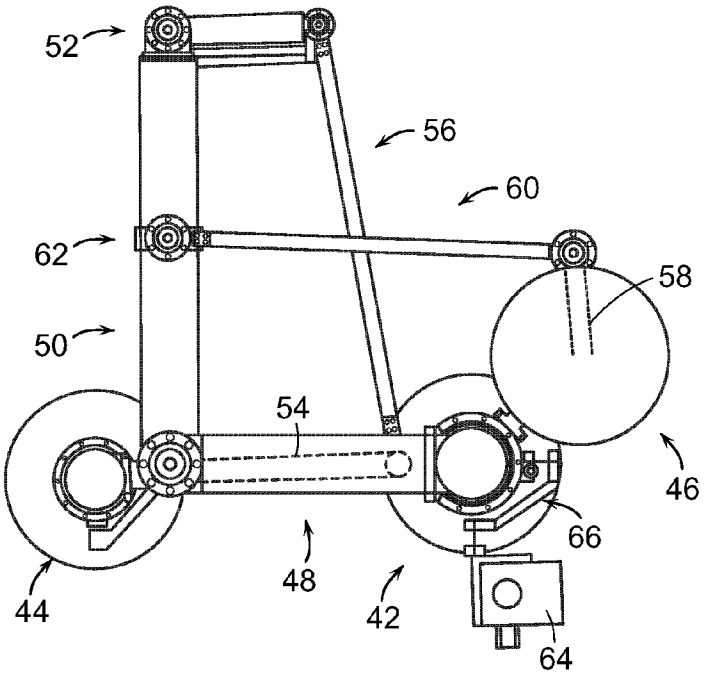
FIG. 6 depicts a plan view of one exemplary embodiment of an arm assembly.

FIG. 6 shows a plan view of an exemplary embodiment of an arm assembly and motors according to the FIG. 5 schematic, and FIG. 7 shows that embodiment in a perspective view. The proximal end of first arm 48 is coupled to shaft (spline) 72 of first motor 42. The distal end of the first arm is coupled by a joint to the proximal end of second arm 50. The distal end of the second arm is coupled to endpoint 52. The proximal end of third arm 54 is coupled to shaft 74 of second motor 44. The distal end of the third arm is coupled by a joint to the proximal end of the fourth arm 56. The distal end of the fourth arm is coupled to the endpoint. The proximal end of the fifth arm 58 is coupled to the shaft 76 of third motor 46. The distal end of the fifth arm is coupled by a joint to the proximal end of the sixth arm 60. The distal end of the sixth arm is coupled to the second arm at point 62.

In one specific embodiment, the arms have the following lengths:

TABLE 1

Arm lengths of one exemplary arm assembly

| Arm | Length |
|---|---|
| First | 16 inches |
| Second | 23 inches |
| Third | 16 inches |
| Fourth | 23 inches |
| Fifth | 5.5 inches |
| Sixth | 21.5 inches |

Also in this particular embodiment, the distal ends of the second and fourth arms are spaced apart from one another on the endpoint by 8 inches, and the distal end of the sixth arm meets the second arm 11 inches from the proximal end of the second arm. The 8-inch separation of the distal ends of the second and fourth arms can make the ratio of inertia of rotation to fore-aft mechanism inertia in the linkage degrees of freedom the same as the ratios between the rotation (about 0.1243 $kg \cdot m^2$) and fore-aft (about 11.9 kg) inertias of a human subject's degrees of freedom. This facilitates matching of the mechanical impedance of the pelvis interface to the mechanical impedance of the human subject, thereby facilitating precise and powerful control of mechanical interaction between the pelvis interface and the human subject.

By making the length of the fifth arm one half the length from the proximal end of the second arm to the intersection point of the sixth arm, the first and sixth arms stay roughly parallel through most of the frontal range of motion of the arm assembly, thus making the amount of torque required from the third motor not strongly dependent on frontal position.

Figure 8:
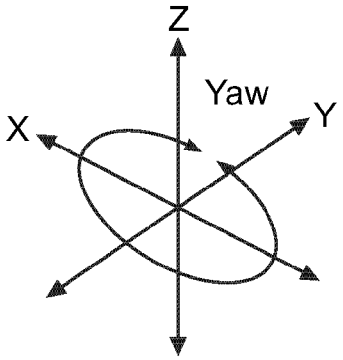
FIGS. 8-9 depict degrees of freedom.
Figure 9:
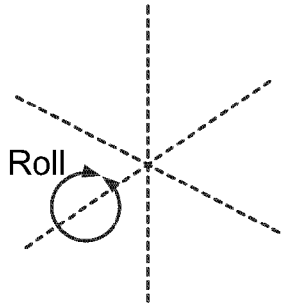

The six arms shown in FIGS. 5-7 are so coupled to one another and/or to the subject attachment module as to provide four degrees of freedom to the endpoint in the transverse and coronal planes, as discussed above and shown as X, Y, and Yaw in FIG. 8 and Roll in FIG. 9, but they do not provide a vertical degree of freedom (shown as Z in FIG. 8). A further motor, such as linear actuator 64, may be coupled to the arm assembly to actuate vertical translation. The linear actuator may include, for example, an electrical linear motor or a rotary motor in combination with a traction drive or a friction drive. The vertical translation motor may be coupled to the arm assembly by a bearing 66 that provides some "play" in the x-y plane to prevent binding as the arm assembly and other components are raised or lowered. The bearing may provide four degrees of freedom for the connection between the vertical actuator and the arm assembly: one translational and one rotational degree of freedom in the two horizontal axes. A four degree-of-freedom bearing may include two plain bearings, each of which provides two degrees of freedom (one translation and one rotation), or two flexures, each of which provides two degrees of freedom through deflection and twisting. The depicted bearing (element 66) is a flexure mechanism.

Arms may be so coupled to one another, to an endpoint, and/or to a motor as to permit relative motion of the coupled elements. For example, two arm ends may be coupled to one another by a bearing, such as a ball bearing, a roller bearing, a barrel-roller bearing, and/or an angular-contact ball bearing.

Figure 10:
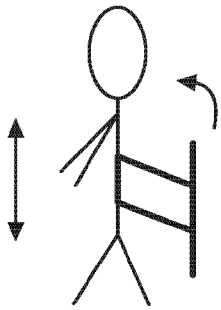
FIGS. 10-14 schematically depict alternative embodiments of arm assemblies.
Figure 11:
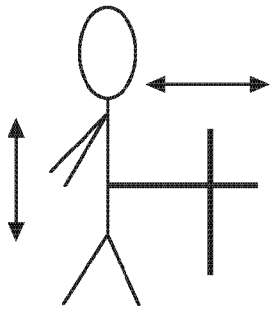
Figure 12:
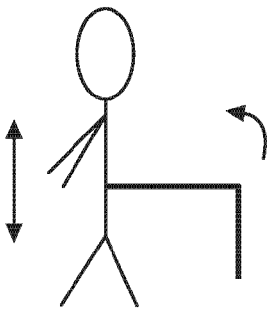
Figure 13:
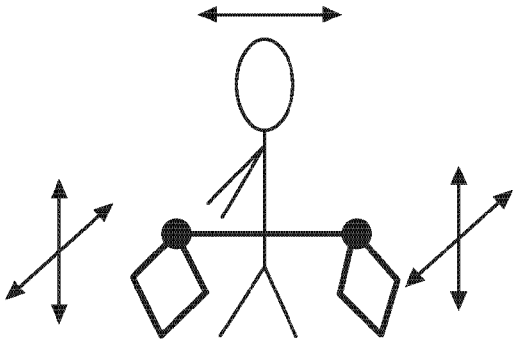
Figure 14:
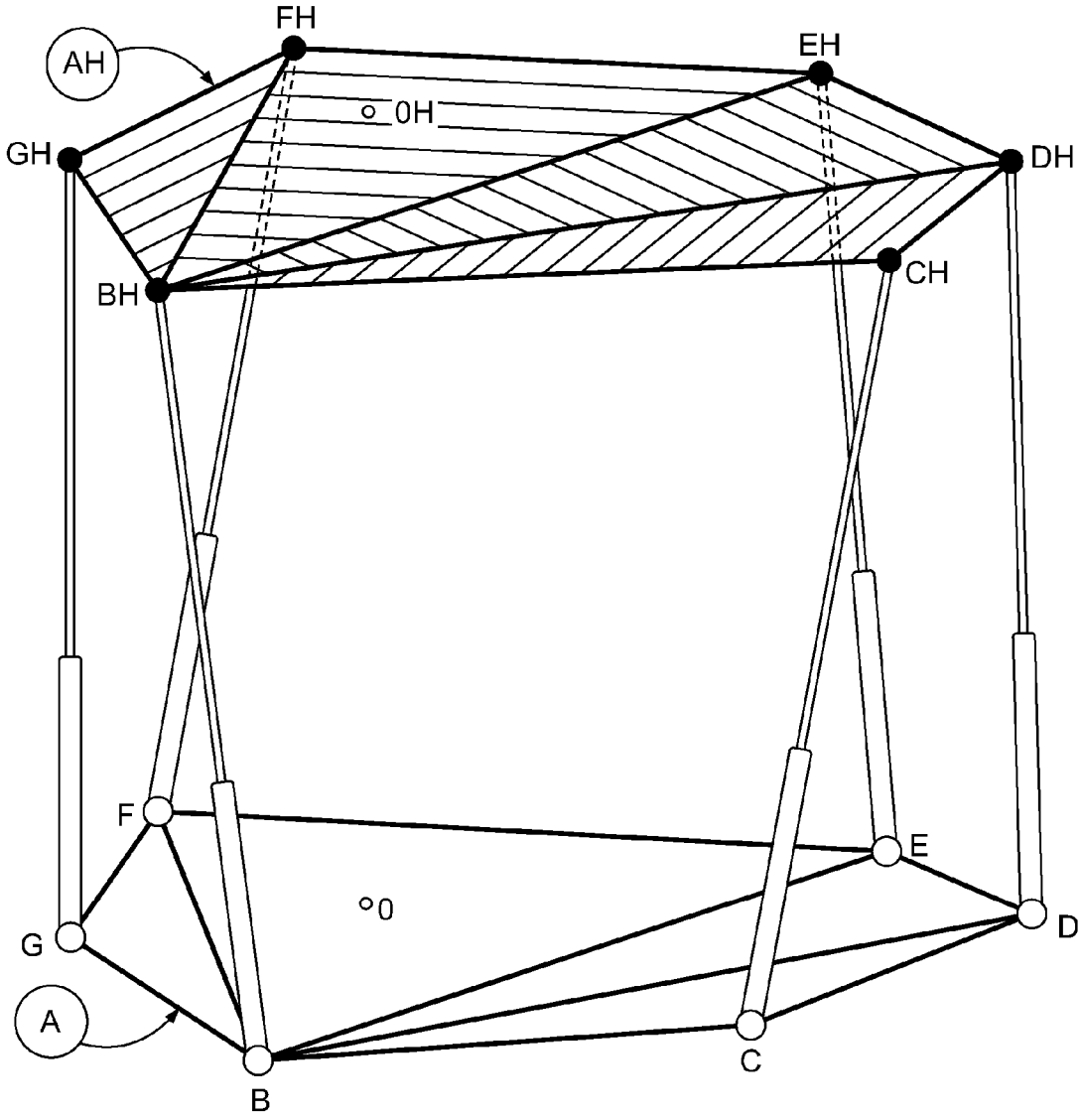

A variety of arm assemblies in addition to the depicted one may be used to provide degrees of freedom for pelvis motion. FIGS. 10, 11, and 12 schematically depict three 2 degree-of-freedom mechanisms. FIG. 13 depicts a five-degree-of-freedom mechanism, and FIG. 14 depicts a six-degree-of-freedom Stewart platform.

Figure 15:
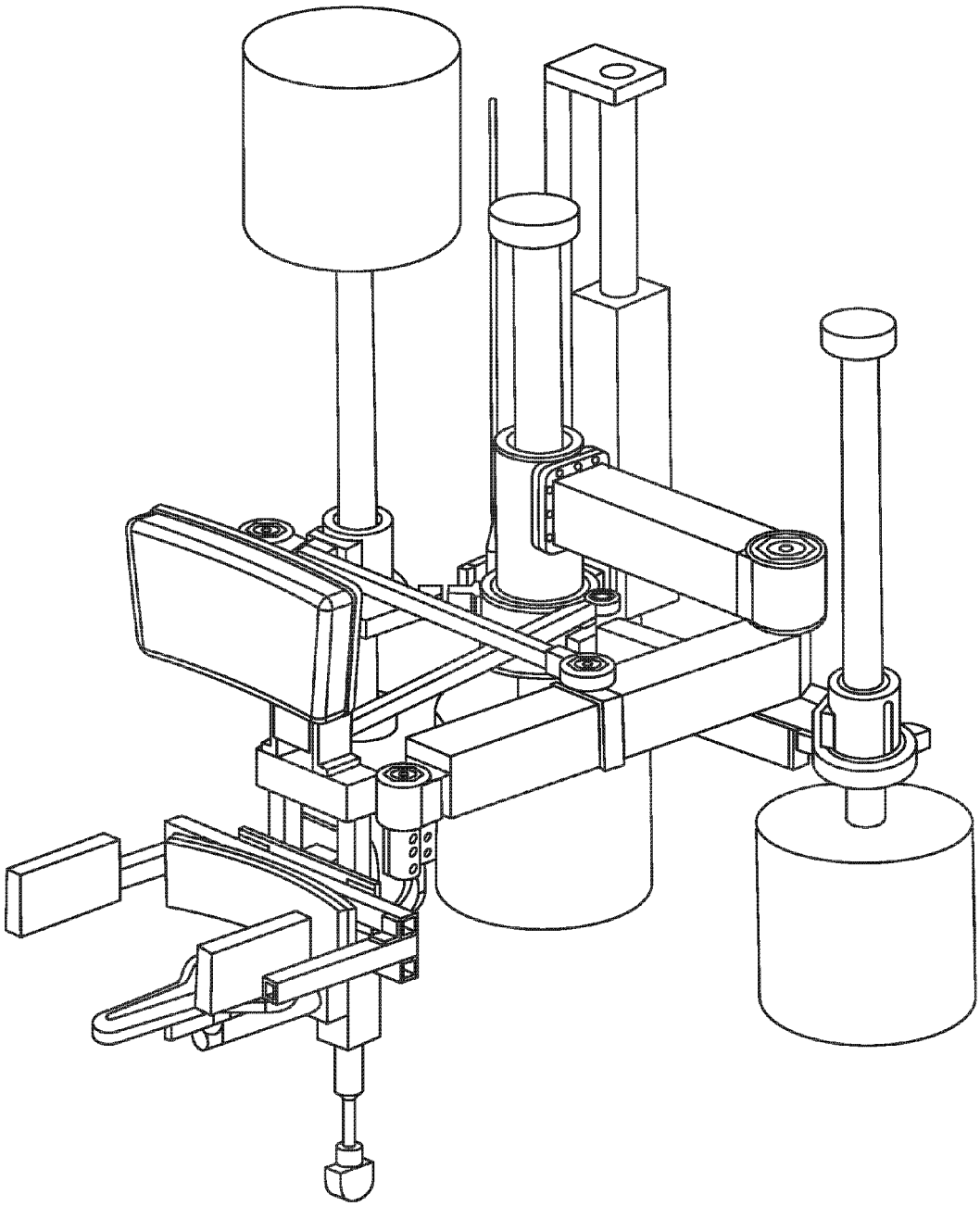
FIG. 15 depicts one exemplary embodiment of a subject attachment module coupled to an arm assembly.

A pelvis interface may include one or more sensors for measuring various properties of a subject's motion. For example, a sensor may measure a positional change, an angular orientation change, a force, a torque, a linear velocity, and/or an angular velocity imposed on the arm assembly by a subject. For example, the endpoint on the arm assembly may include a force transducer. The subject attachment module may be coupled to the arm assembly by being attached to the force transducer (FIG. 15, force transducer obscured by the subject attachment module). The force transducer can measure forces exerted by a subject upon the arm assembly.

The one or more sensors may produce one or more output signals indicative of the measured property. The sensor output may be communicated to a controller, which, in turn, outputs signals to one or motors coupled to the arm assembly to control the arm assembly and, consequently, the subject attachment module. The mechanical impedance or mechanical admittance of the interface can thus be substantially determined by the combined actions of the controller, motors and sensors. In this way, the subject's actions can serve as feedback to the pelvis interface to control the interface's interaction with the subject. Such control can be implemented in a variety of ways. For example, the sensor(s) may measure motion of the arm assembly induced by the subject, and the controller may respond, if necessary, by commanding the motor(s) to exert torques on the subject attachment module. Alternatively, the sensor(s) may measure force exerted on the arm assembly by the subject, and the controller may respond, if necessary, by commanding the motors in such a way as to displace the subject attachment module. Such control systems are known by a variety of names, such as "interaction control," "impedance control, and "admittance control," among others. Other interactive robot systems are described, e.g., in U.S. Pat. No. 5,466,213 to Hogan et al., which is hereby incorporated herein by reference.

Figure 16:
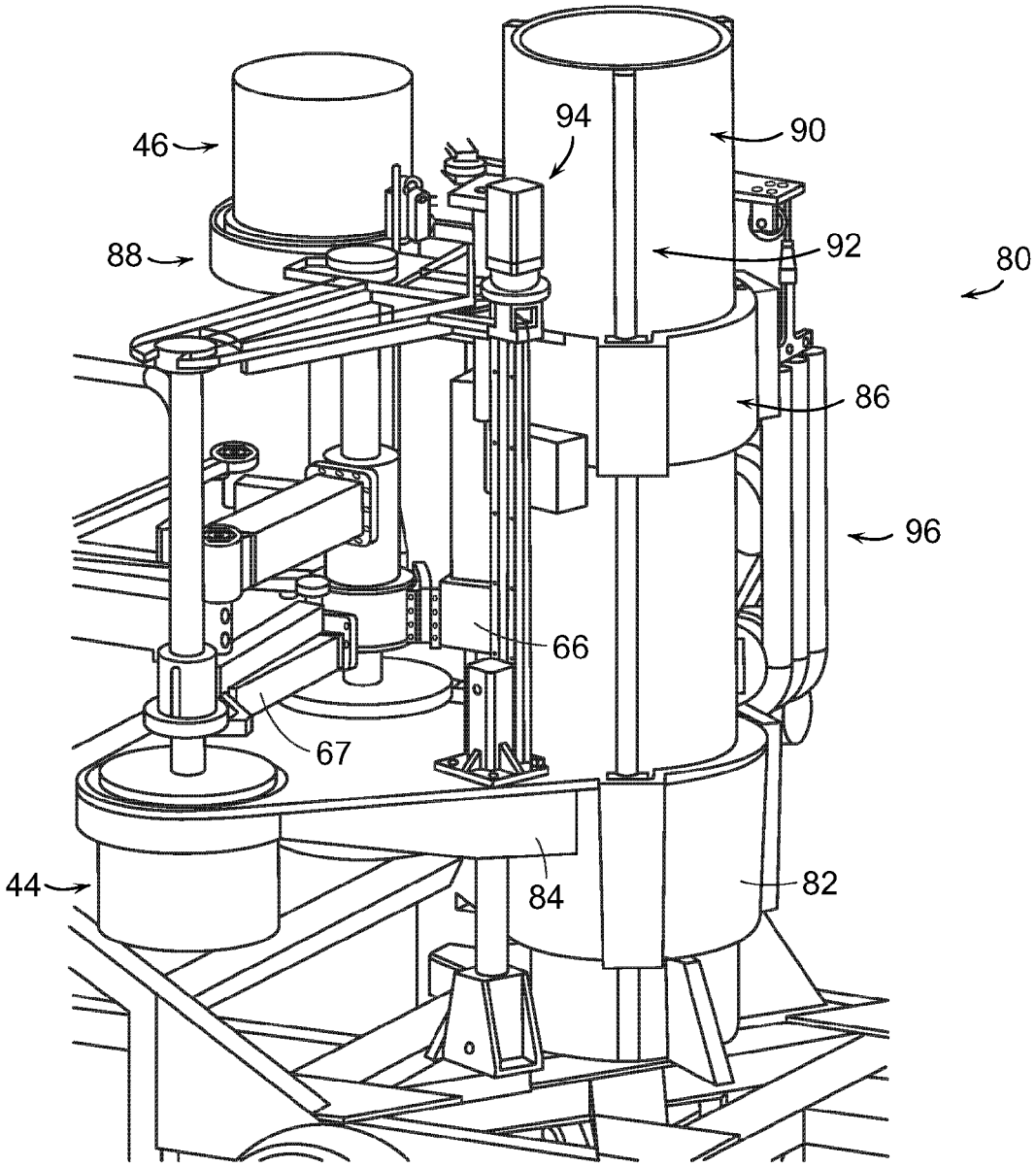
FIG. 16 depicts one exemplary embodiment of a height adjustment system.

FIG. 16 depicts an exemplary embodiment of a height adjustment system 80 that permits vertical adjustment of the arm assembly to accommodate subjects of varying sizes. The height adjustment system may include first collar 82 that slides along tube 90. The tube may include a groove or rail 92, and the collar a complementary feature, to prevent rotation. The collar may include one or more arms 84 that extend to and support the lower motors (such as second motor 44). A second collar 86 may also be positioned on the tube at a fixed distance from the first collar and has arms and a receptacle 88 to support, e.g., the third motor 46. The height adjustment system may also include a motor 94 to assist in adjusting assembly height.

Figure 17:
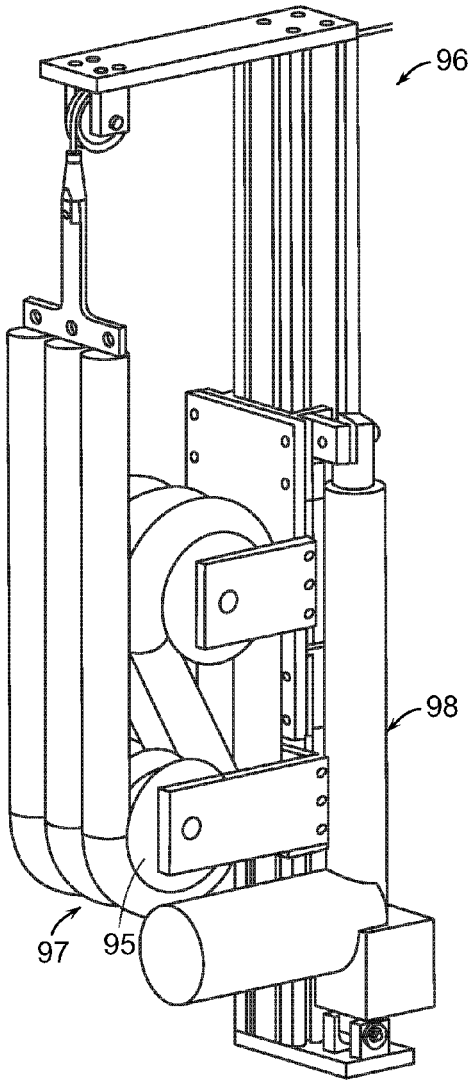
FIG. 17 depicts one exemplary embodiment of a body weight support in a first state.
Figure 18:
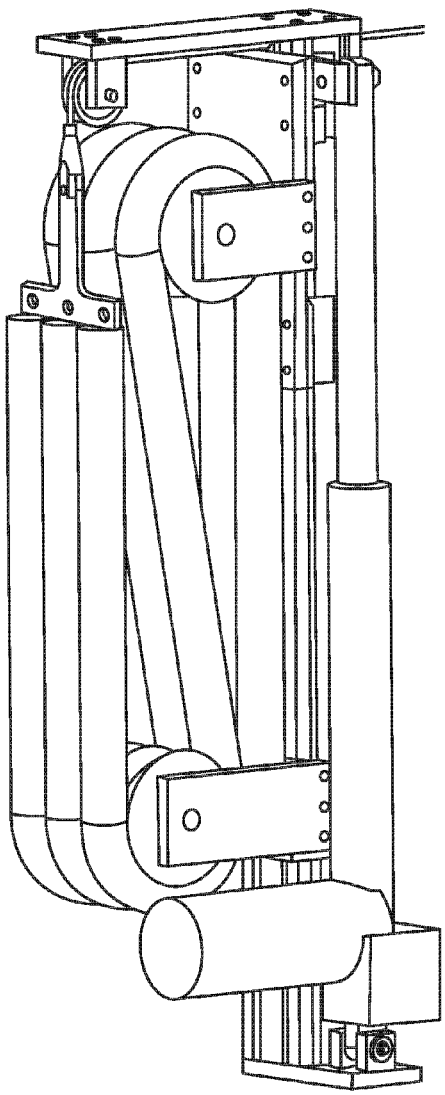
FIG. 18 depicts the body weight support embodiment in a second state.
Figure 19:
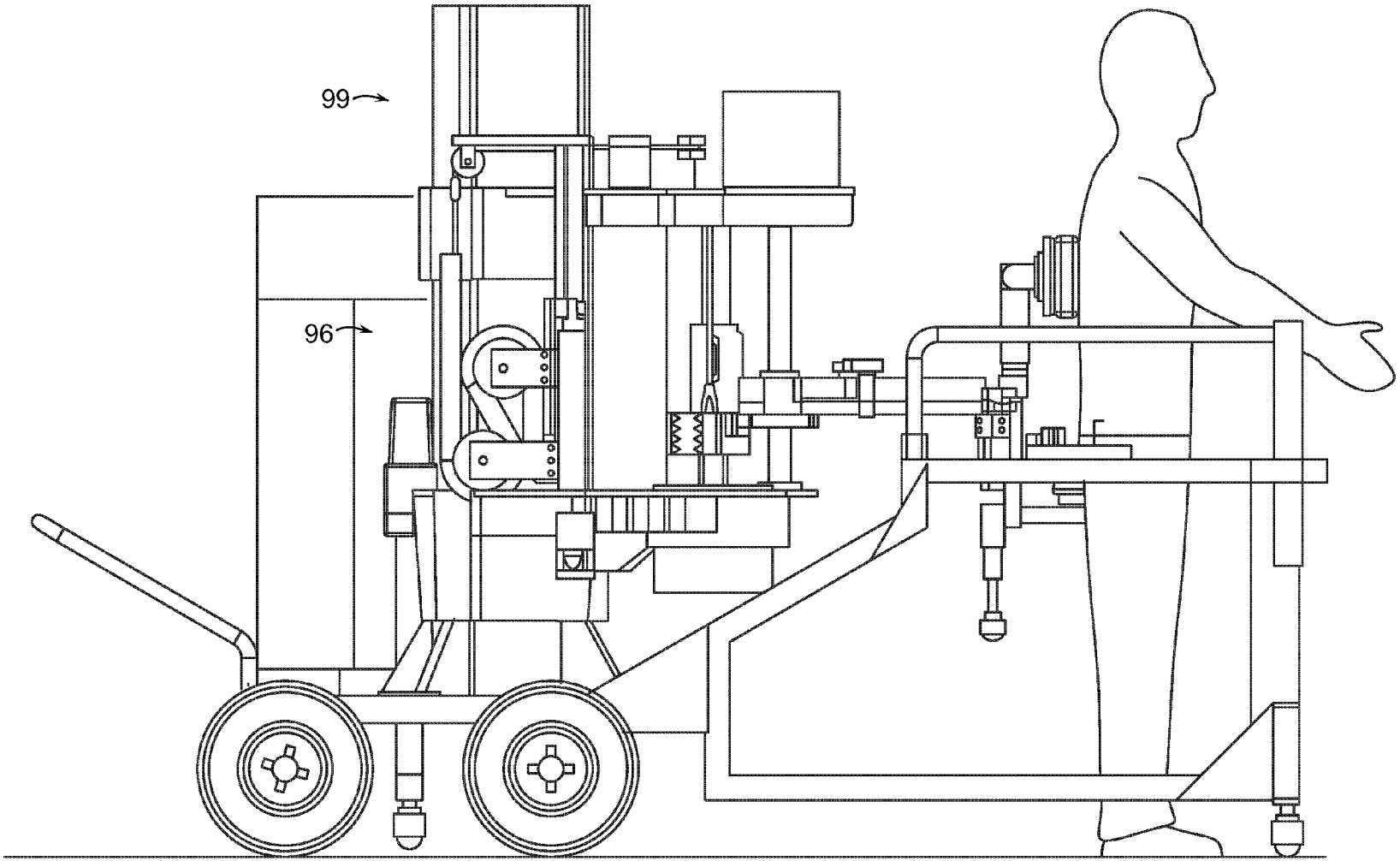
FIG. 19 depicts an exemplary embodiment of a pelvis interface.

FIGS. 17-18 depict an exemplary embodiment of a body weight support 98, and FIG. 19 shows the body weight support incorporated in a pelvis interface. During use of the pelvis interface, a subject being supported by the subject attachment module will exert a downward force on the attachment module and the arm assembly equal to some or all of his or her body weight. This downward force may be compensated for using a combination of passive (non-motorized) and active (motorized) methods. Using passive methods relieves the vertical actuating motor of the burden of supporting this extra weight. The body weight support may also help prevent an attached subject who loses balance, or is otherwise disturbed or incapacitated, from falling.

A variety of compensatory systems may be employed, including active elements, such as an additional actuator, or passive elements, such as a counterweight, coil spring, constant force spring, charged gas spring, surgical tubing spring, or other elastic element. In the depicted embodiment, the body weight support includes an elastic element 97 (in this case, rubber tubing having a spring constant of 1.6 lb/in) and an adjuster 98 (in this case, a lead screw) to adjust the spring tension and thereby control the amount of weight which the body weight support counteracts. The spring may be set to compensate for the average weight to be unloaded from the vertical actuating motor, which can then actuate around this unloaded weight to move the pelvis up or down. The body weight support may be transitioned, for example, from a low-tension, low-weight-compensating state (such as in FIG. 17) to a higher-tension, higher-weight-compensating state (such as in FIG. 18) by manipulating the adjuster. In the depicted embodiment, the tubing is wrapped around pulleys 95 to make the support system more compact. A transmission system, such as cable-and-pulley system 99, may be used to transmit the spring force to the vertical actuating motor.

Figure 20:
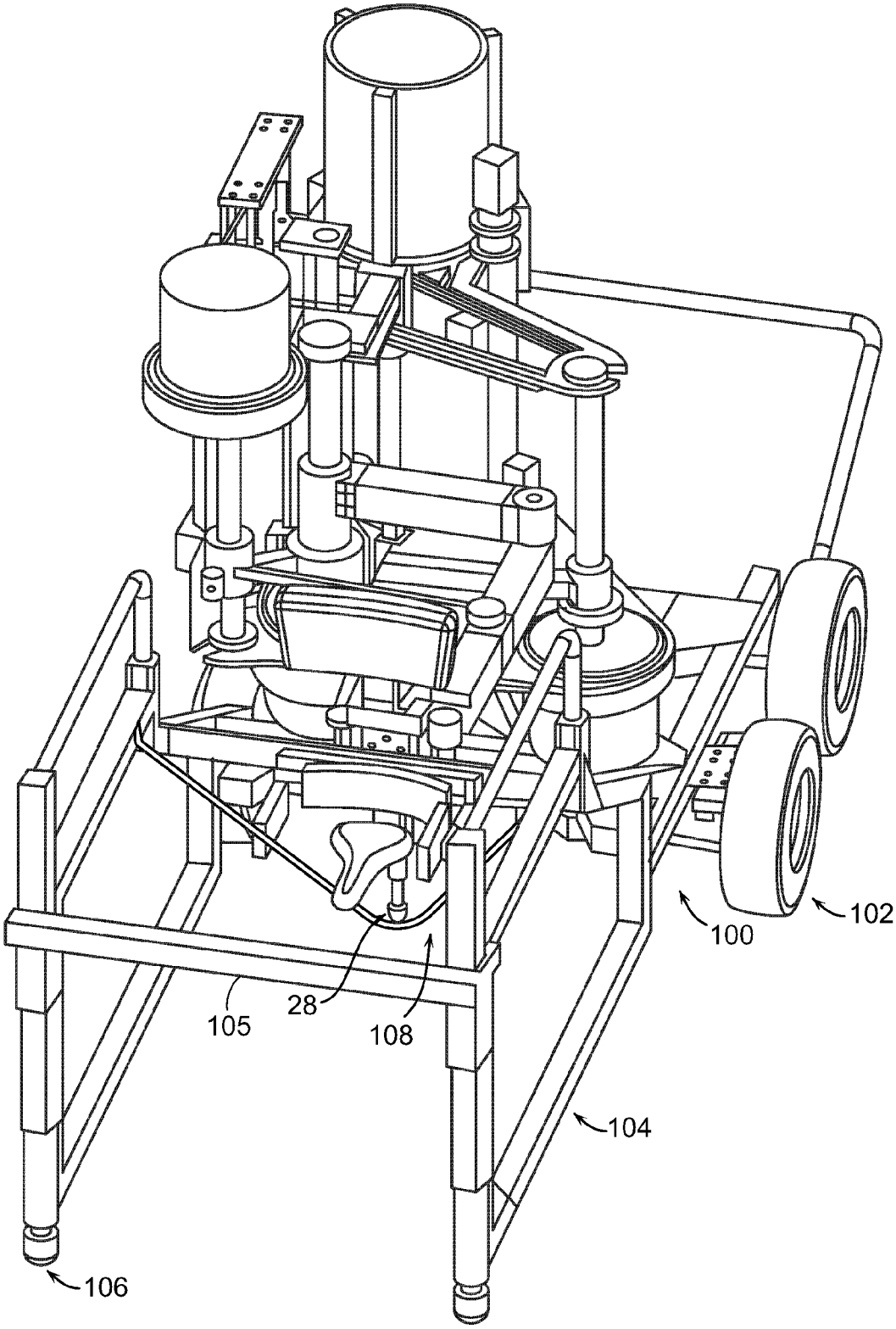
FIGS. 20-22 each depict one exemplary embodiment of a pelvis interface.
Figure 24:
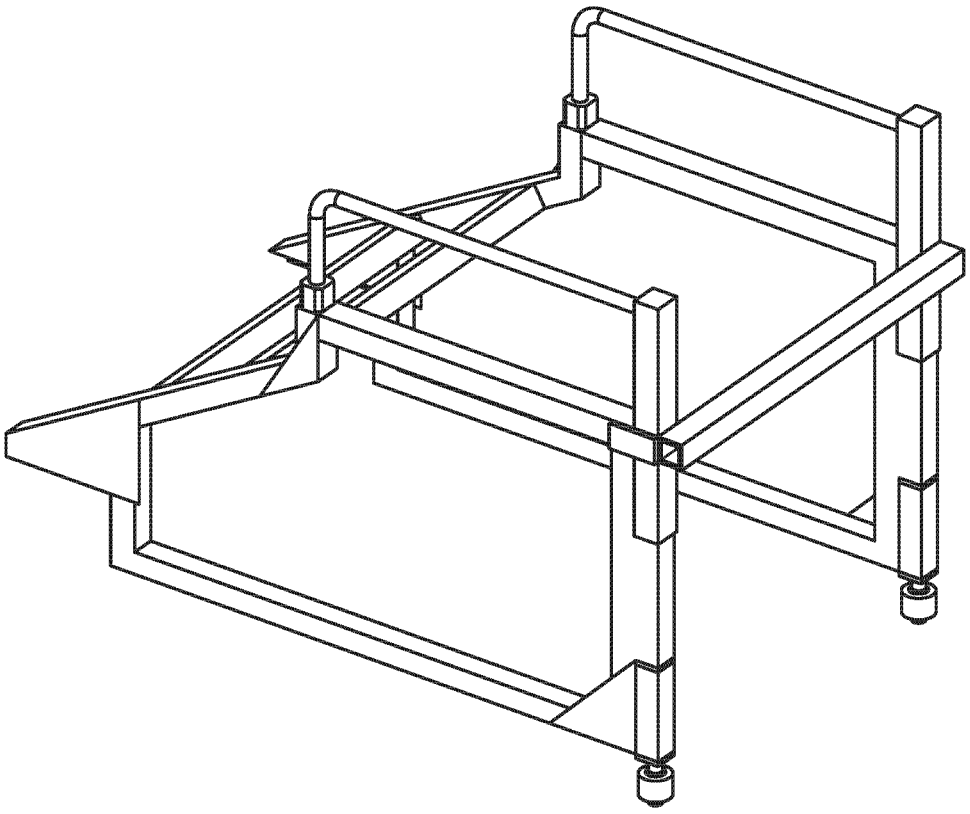
FIG. 24 depicts one exemplary embodiment of a hand rail.

FIG. 20 depicts another exemplary embodiment of a pelvis interface to illustrate additional features. The interface may include a base 100 that supports the motors, tube 90, and various other structures. The base may include a movement system, such as wheels 102 to allow the interface to be mobile. One or more wheels may be actuated to facilitate propulsion of the interface. The base may also include a steering system to enable guidance along straight, curved, erratic, pre-planned, and/or random paths. The interface may also include a rail system 104. The rail system may provide hand rails which a subject may grasp for support during interface use. The rail system may also include a gate 105 that opens to provide the subject entry to the interior of the rail system. The rail system may include one or more casters 106, particularly on the front legs of the rail system, to help balance the interface and to help it roll during use. The rail system is showed in isolation in FIG. 24 for clarity. In this illustrated embodiment, a cable 108 is attached to hand rails of the rail system 104 and passes under damper 28.

Figure 21:
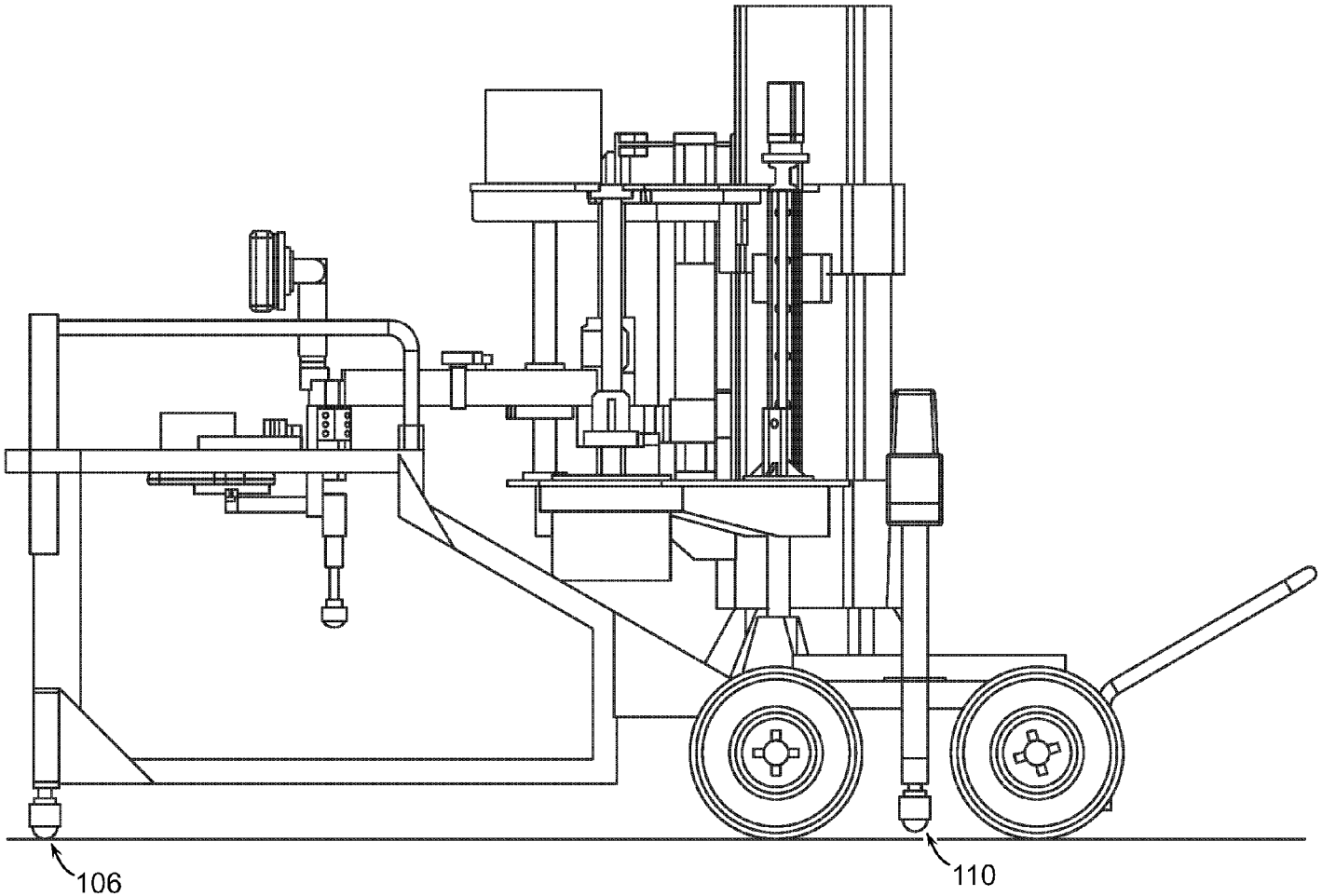
Figure 22:
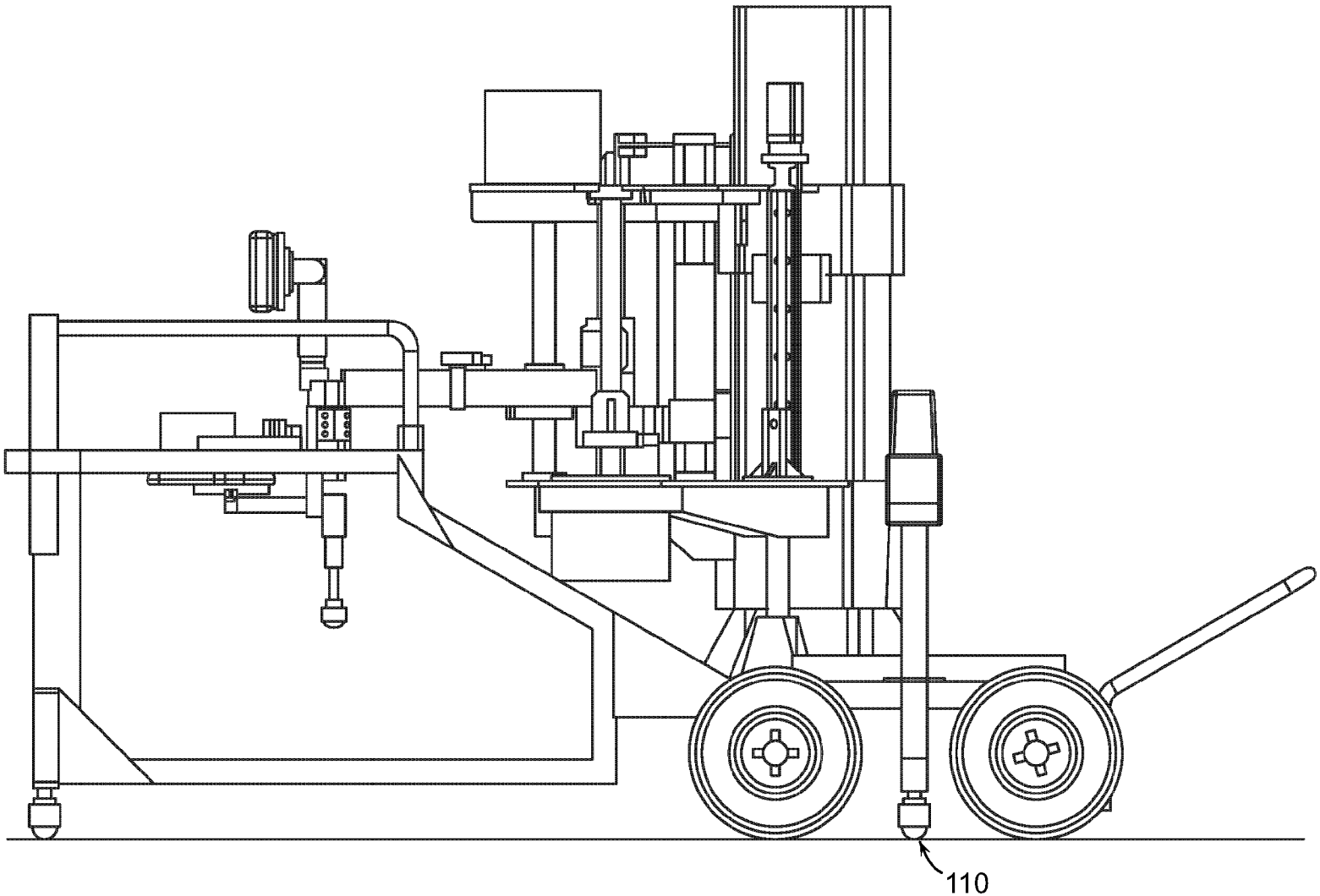

FIG. 21 shows a side elevation view of an embodiment of a pelvis interface in condition for linear movement. The bottoms of the wheels and casters are even, and the interface may roll along the floor. FIG. 22 shows the interface in condition for pivoting. A jack 110 may be so lowered and planted as to cause the back wheels to lift off the ground. A torque in the horizontal plane is applied to the interface; the interface then pivots on the jack and the casters. Spherical wheels may instead be used to provide rotation.

Figure 23:
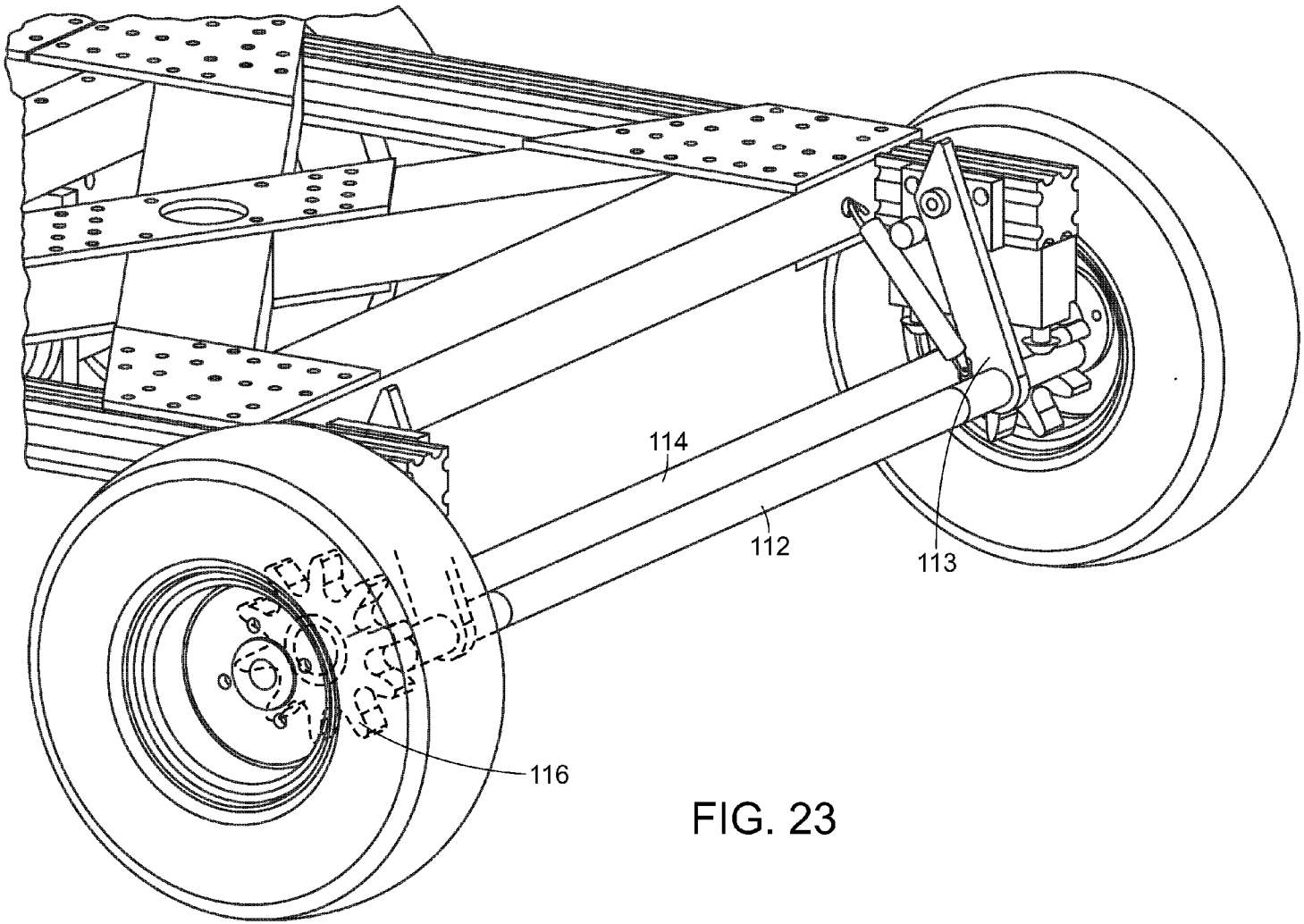
FIG. 23 depicts one exemplary embodiment of a locking system for the base of a pelvis interface.

FIG. 23 shows an exemplary embodiment of a locking system to immobilize the base of the interface. Bar 112 is shaped and positioned so that when it is pulled by a lever 113, it engages a groove of gear 116 rigidly attached to wheel axle 114. This prevents further rotation of the axle, thus immobilizing the base of the interface.

Figure 25:
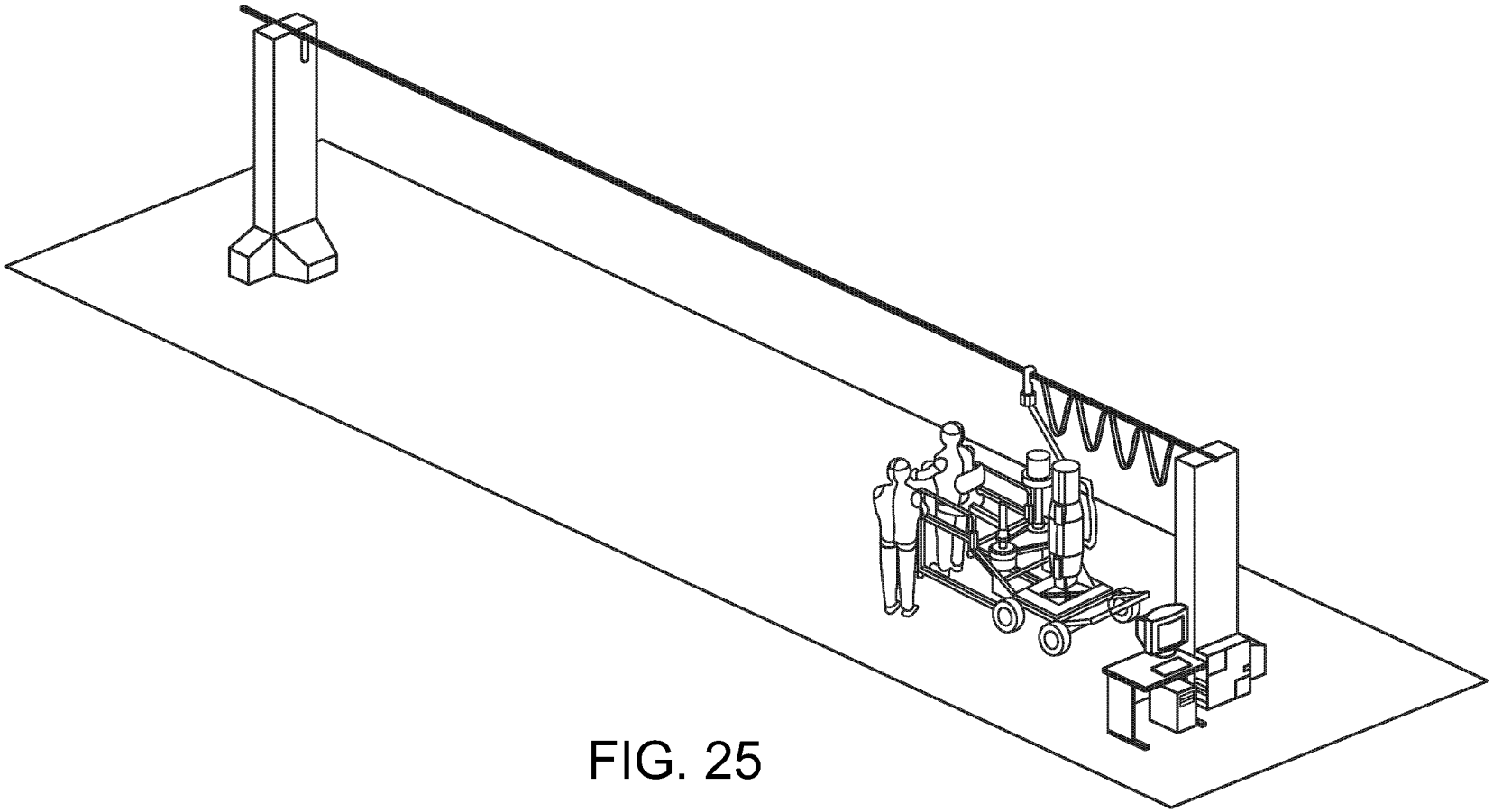
FIG. 25 depicts one exemplary embodiment of a pelvis interface system operating overground.

FIG. 25 shows an exemplary embodiment of a pelvis interface system that includes a pelvis interface described herein and a cable assembly system for overground training. The cable assembly system may provide power to the pelvis interface. Although the depicted cable system is linear, it may also be curved or given other shapes, as available space and intended use dictate.

Alternatively, the pelvis interface may include a power source on its base, thereby making the interface independently mobile.

Figure 26:
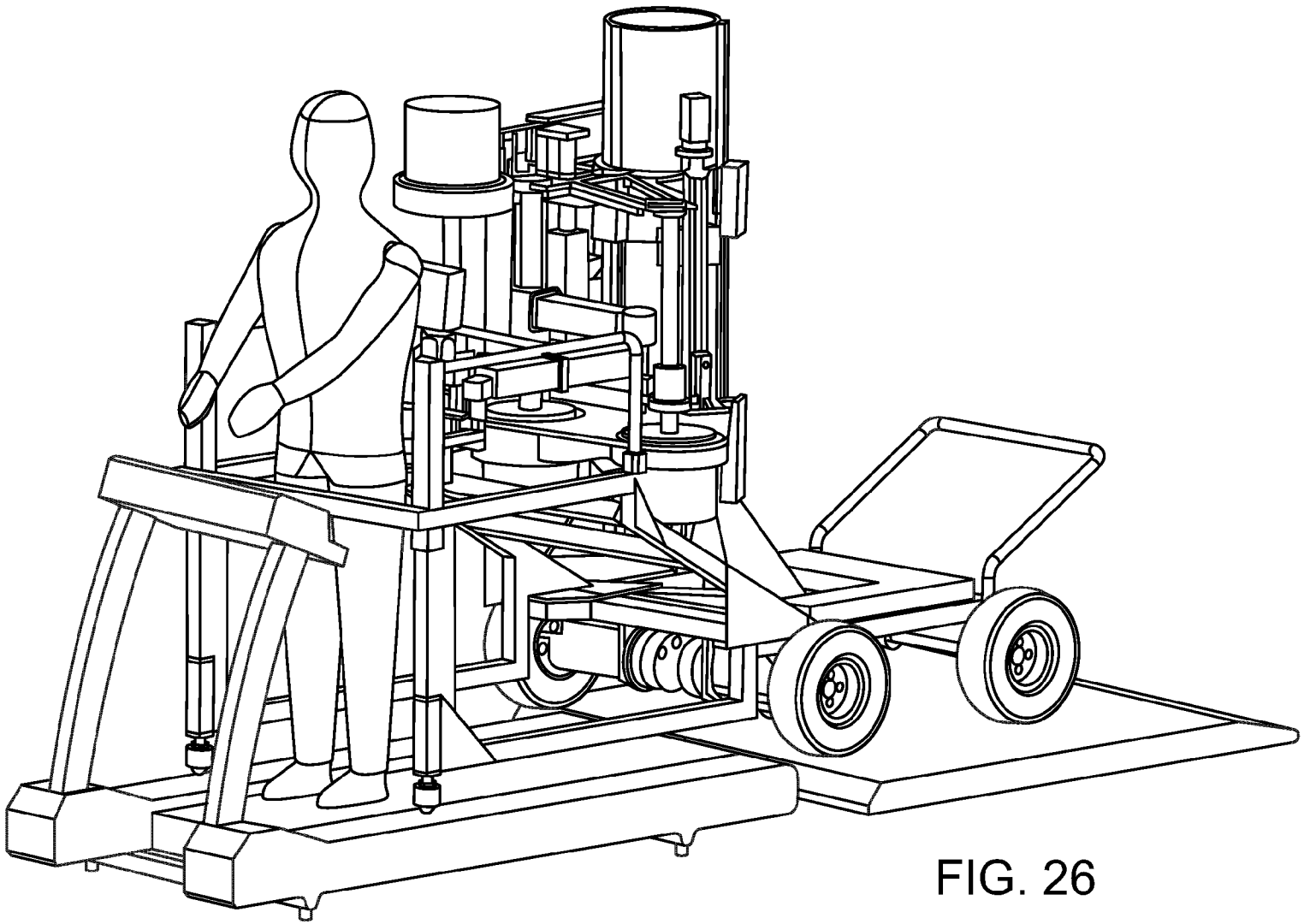
FIG. 26 depicts one exemplary embodiment of a pelvis interface operating over a treadmill.

FIG. 26 depicts a pelvis interface in combination with a treadmill to permit stationary use of the interface.

As mentioned above, the pelvis interfaces described herein may be used for a wide variety of purposes. Examples include:

1. Gait training following stroke, traumatic brain injury, multiple sclerosis exacerbation, cerebral palsy, Parkinson's Disease, spinal cord injury, following amputation, following prosthetic limb replacement, and following hip fracture and/or replacement. Training may occur at a treadmill or overground, the latter providing superior coordination of sensory stimuli (especially visual and vestibular, important for balance) with muscle and joint activity. Training may emphasize lateral weight-shifting, important for proper un-weighting of a leg prior to the swing phase of gait. Training may emphasize fore-and-aft weight-shifting, important for initiating a step at the onset of locomotion and for terminating locomotion into upright posture. Training may assist gait initiation and threshold-crossing, especially important for patients with Parkinson's Disease. With interaction control, the motorized pelvis interface may facilitate the pendulous hip motions that are an essential rhythmic component of normal locomotion.

2. Reduced-weight training to allow weakened muscles to participate in balance and locomotor activity.

3. Standing-to-sitting and/or sitting-to-standing transition training.

4. Obstacle training.

5. Balance training by perturbing the subject with the interface.

6. Robotic manipulator for assisting an operator in the use of a piece of machinery, potentially remotely, or in the assembly and mating of heavy components.

7. Combination therapy with other interfaces, such as an ankle interface disclosed in U.S. patent application Ser. No. 11/236,470.

8. Combination therapy with electromagnetic brain stimulation, such as transcranial magnetic stimulation, repeated transcranial magnetic stimulation, transcranial direct current stimulation (anodic or cathodic), cortical stimulation, deep brain stimulation, among others.

9. Combination therapy with pharmaceuticals or biologicals. A wide variety of therapeutic treatments are used to treat neurological and musculoskeletal disorders. Broad categories of treatments include drugs, biologicals (peptides, proteins, nucleic acids, vaccines, viruses, cells, stem cells, neural stem cells, hematopoietic stem cells, progenitor cells, neural progenitor cells, hematopoietic progenitor cells, olfactory ensheathing glial cells, tissue), human-administered physical therapy, and device-administered physical therapy (such as with the attachments and motion devices disclosed herein). Treatments may be combined; for example, a drug may be combined with another drug, or with a biological (such as stem cells), or with a physical therapy. Combinations may be simultaneous (given at the same time), sequential (given one after the other), or given at defined intervals. Combinations of drugs and/or biologicals may be admixed for administration together. Administration of drugs and/or biologicals can be by any route of administration, including per os and parenteral (topical, intravenous, intramuscular, subcutaneous, intra-arterial, intrathecal, intrapleural, intraperitoneal, intrarectal, intravesical, intralesional).

Drugs typically used to treat Alzheimer's disease or related symptoms include cholinesterase inhibitors (such as tacrine and donepezil), rivastigmine, galantamine, galanthamine, memantine, metrifonate, bryostain, methylxanthine, non-steroidal anti-inflammatory drugs (rofecoxib, naxopren, celecoxib, aspirin, ibuprofen), vitamin E, selegiline, estrogen, ginkgo biloba extract, antidepressants, neuroleptics and mood stabilizers.

Drugs typically used to treat pain include analgesics (acetaminophen, acetaminophen with codeine, hydrocodone with acetaminophen, morphine sulfate, oxycodone, oxycodone with acetaminophen, propoxyphene hydrochloride, propoxyphene with acetaminophen, tramadol, tramadol with acetaminophen) and non-steroidal anti-inflammatory drugs (NSAIDs; diclofenac potassium, diclofenac sodium, diclofenac sodium with misoprostol, diflunisal, etodolac, fenoprofen calcium, flurbiprofen, ibuprofen, indomethacin, ketoprofen, meclofenamate sodium, mefenamic acid, meloxicam, nabumetone, naproxen, naproxen sodium, oxaprozin, piroxicam, sulindac, tolmetin sodium, choline and magnesium salicylates, choline salicylate, magnesium salicylate, salsalate, sodium salicylate).

Drugs typically used to treat ALS or related symptoms include riluzole, baclofen, tiranadine, dantrolene, benzodiazepines (such as diazepem), gabapentin, NSAIDs, cox2 inhibitors, tramadol, antidepressants, selective serotonin re-uptake inhibitors, selective dopamine blockers, branch-chain amino acids, phenytoin, quinine, lorazepam, morpine, arimoclomol, and chlorpromazine.

Drugs typically used to treat Parkinson's disease or related symptoms include levodopa, carbidopa, selegiline, bromocriptine, pergolide, amantadine, trihexphenidyl, benztropine, COMT inhibitors (catechol-O-methyl transferase), anticholinergics, dopamine precursors, dopamine receptor agonists, MAO-B inhibitors, and peripheral decarboxylase inhibitors.

Drugs typically used to treat Huntington's disease or related symptoms include neuroleptic agents, dopamine receptor blockers (such as haloperidol and perphenazine), presynaptic dopamine depletors (such as reserpine), clozapine, antidepressants, mood stabilizer, and antipsychotic agents.

Drugs typically used to treat multiple sclerosis or related symptoms include interferon beta-1a, interferon beta-1b, glatiramer, mitoxantrone, natalizumab, corticosteroids (such as prednisone, methylprednisolone, prednisolone, dexamethasone, adreno-corticotrophic hormone (ATCH), and corticotropin), chemotherapeutic agents (such as azathiprine, cyclophosphamide, cyclosporin, methotrexate, cladribine), amantadine, baclofen, meclizine, carbamazepine, gabapentin, topiramate, zonisamide, phenytoin, desipramine, amitriptyline, imipramine, doxepin, protriptyline, pentoxifylline, ibprofen, aspirin, acetaminophen, hydroxyzine, antidepressants, and antibodies that bind to $\alpha$4-integrin (b1 and b7), e.g., TYSABRI® (natalizumab).

Compounds typically used to treat chronic stroke include benzodiazepines (such as midazolam), amphetamines (such as dextroamphetamine), type IV phosphodiesterase inhibitors (such as rolipram), type V phosphodiesterase inhibitors (such as sildenafil), and HMG-coenzyme A reductase inhibitors (such as atorvastatin and simvastatin) and nitric oxide donors, especially indirect nitric oxide donors. Other drugs of interest in treating stroke include inhibitors of mitochondrial permeability transition such as heterocyclics (methiothepin, mefloquine, propiomazine, quinacrine, ethopropazine, cyclobenzaprine, propantheline), antipsychotics (trifluoperazine, triflupromazine, chlorprothixene, promazine, thioridazine, chlorpromazine, prochlorperazine, perphenazine, periciazine, clozapine, thiothixene, pirenzepine), antidepressants (clomipramine, nortriptyline, desipramine, amitriptyline, amoxepine, maprotiline, mianserin, imipramine, doxepin), and antihistamines (promethazine, flufenazine, pimethixine, loratadine), mitochondial uncouplers such as 2,4-dinitrophenol, and antineoplastic drugs such as DNA intercalators (mithramycin).

Drugs typically used to treat acute stroke and spinal cord injury include thrombolytics (tissue plasminogen activator, alteplase, tenecteplase, and urokinase), antiplatelet agents (aspirin, clopidogrel, abciximab, anagrelide, dipyridamole, eptifibatide, ticlodipine, tirofiban), and anticoagulants (warfarin, heparin).

Drugs typically used to treat arthritis include cox2 inhibitors (etoricoxib, valdecoxib, celecoxib, rofecoxib), NSAIDs, and analgesics.

Drugs typically used to treat rheumatoid arthritis include auranofin, azathioprine, chlorambucil, cyclophosphamide, cyclosporine, gold sodium thiomalate, hydroxychloroquine sulfate, leflunomide, methotrexate, minocycline, penicillamine, sulfasalazine, TNF inhibitors (adalimumab, etanercept, infliximab), IL-1 inhibitors (anakinra), and corticosteroids (betamethasone, cortisone acetate, dexamethasone, hydrocortisone, methylprednisolone, prednisolone, prednisolone sodium phosphate, prednisone).

Drugs typically used to treat fibromyalgia include NSAIDs, analgesics, and antidepressants (amitriptyline hydrochloride, duloxetine, fluoxetine). The drugs described above can be combined with one another and with other substances. Combination therapies include conjoint administration with nicotinamide, $NAD^+$ or salts thereof, other Vitamin B3 analogs, and nicotinamide riboside or analogs thereof. Carnitines, such as L-carnitine, may be co-administered, particularly for treating cerebral stroke, loss of memory, pre-senile dementia, Alzheimer's disease or preventing or treating disorders elicited by the use of neurotoxic drugs. Cyclooxygenase inhibitors, e.g., a COX-2 inhibitor, may also be co-administered for treating certain conditions described herein, such as an inflammatory condition or a neurologic disease.

We claim:

1. A pelvis interface comprising:

a subject attachment module including:

a waist attachment; and a back attachment;

a base;

an arm assembly coupled to the subject attachment module and the base, the arm assembly including a plurality of arms so coupled to one another and/or to the subject attachment module and/or the base as to permit the subject attachment module to have, relative to the base, at least one pelvis translation degree of freedom and at least one pelvis rotation degree of freedom; and motors so coupled to the arm assembly as to actuate the subject attachment module relative to the base in the at least one pelvis translation degree of freedom and the at least one pelvis rotation degree of freedom;

wherein the back attachment is coupled to the waist attachment through an arm having two joints that allow the back attachment to have at least two rotational degrees of freedom relative to the waist attachment.

2. The interface of claim 1, wherein the at least one pelvis rotational degree of freedom is about a vertical axis.

3. The interface of claim 2, wherein one or more of the motors is so coupled to the arm assembly as to actuate the rotational degree of freedom about the vertical axis.

4. The interface of claim 2, wherein the arm assembly further permits a second pelvis rotation degree of freedom about a forward-backward axis.

5. The interface of claim 1, wherein the at least one translation degree of freedom is along a vertical axis.

6. The interface of claim 1, wherein the at least one translation degree of freedom is in a horizontal plane.

7. The interface of claim 6, wherein the arm assembly further permits a second pelvis translation degree of freedom.

8. The interface of claim 7, wherein the second pelvis translation degree of freedom is in the horizontal plane.

9. The interface of claim 7, wherein the second pelvis translation degree of freedom is along a vertical axis.

10. The interface of claim 7, wherein the arm assembly further permits a third pelvis translation degree of freedom.

11. The interface of claim 10, wherein two of the pelvis translation degrees of freedom are in the horizontal plane and the third pelvis translation degree of freedom is along a vertical axis.

12. The interface of claim 11, wherein at least one motor actuates the vertical pelvis translation degree of freedom.

13. The interface of claim 11, wherein the motors actuate the two horizontal pelvis translation degrees of freedom.

14. The interface of claim 11, wherein the motors actuate the three pelvis translation degrees of freedom.

15. The interface of claim 14, wherein the at least one pelvis rotational degree of freedom is about a vertical axis.

16. The interface of claim 15, wherein at least one motor actuates the pelvis rotation degree of freedom about the vertical axis.

17. The interface of claim 11, wherein the arm assembly further permits a second pelvis rotation degree of freedom.

18. The interface of claim 17, wherein the arm assembly further permits a third pelvis rotation degree of freedom.

19. The interface of claim 18, wherein the pelvis rotation degrees of freedom are about vertical, forward-backward, and site-to-side axes, respectively.

20. The interface of claim 17, wherein the motors actuate the three pelvis translation degrees of freedom and at least one pelvis rotation degree of freedom.

21. The interface of claim 20, wherein at least one motor actuates the pelvis rotation degree of freedom about the vertical axis.

22. The interface of claim 20, wherein at least one motor further actuates the second pelvis rotation degree of freedom, the second pelvis rotation degree of freedom being about a forward-backward axis.

23. The interface of claim 22, wherein the subject attachment module is coupled to the arm assembly at least through a rotary bearing that permits rotation of the subject attachment module about the forward-backward axis, and further comprising a motor actuating the rotary bearing.

24. The interface of claim 17, wherein the subject attachment module is coupled to the arm assembly at least through a rotary bearing that permits rotation of the subject attachment module about the forward-backward axis.

25. The interface of claim 1, wherein the waist attachment comprises a seat so sized and shaped as to support the pelvis of a subject.

26. The interface of claim 1, wherein the arm assembly comprises a force transducer to which the subject attachment module is coupled.

27. The interface of claim 1, further comprising a height adjustment system so coupled to the arm assembly and so configured as to permit adjustment of the position of the subject attachment module along a vertical axis.

28. The interface of claim 27, wherein the height adjustment system further comprises a height adjustment motor.

29. The interface of claim 1, further comprising a body weight support coupled to at least one of the arm assembly and the subject attachment module.

30. The interface of claim 1, wherein the plurality of arms in the arm assembly comprises a first arm, a second arm, a third arm, a fourth arm, a fifth arm, and a sixth arm, each arm having a proximal end and a distal end; and the plurality of motors comprises a first motor, a second motor, and a third motor.

31. The interface of claim 30, wherein:

(a) the proximal end of the first arm is coupled to the first motor;

(b) the distal end of the first arm is coupled to the proximal end of the second arm;

(c) the distal end of the second arm is coupled to the subject attachment module or to a force transducer to which the subject attachment module is coupled;

(d) the proximal end of the third arm is coupled to the second motor;

(e) the distal end of the third arm is coupled to the proximal end of the fourth arm;

(f) the distal end of the fourth arm is coupled to the subject attachment module or to a force transducer to which the subject attachment module is coupled;

(g) the proximal end of the fifth arm is coupled to the third motor;

(h) the distal end of the fifth arm is coupled to the proximal end of the sixth arm; and (i) the distal end of the sixth arm is coupled to the second arm.

32. The interface of claim 31, wherein the various arm ends are coupled to one another with ball bearings.

33. The interface of claim 30, further comprising a fourth motor coupled to the arm assembly and configured to actuate translation along a vertical axis.

34. The interface of claim 33, further comprising a fifth motor coupled to the arm assembly and configured to actuate rotation about a forward-backward axis.

35. The interface of claim 1, wherein one of the motors is configured to actuate translation along a vertical axis and is coupled to the arm assembly through a bearing.

36. The interface of claim 1, further comprising a vertically-oriented damper affixed to an underside of the waist attachment.

37. The interface of claim 1, further comprising a base to which the motors are affixed.

38. The interface of claim 37, further comprising a hand rail coupled to the base and extending alongside the subject attachment module.

39. The interface of claim 38, further comprising a vertically-oriented damper affixed to an underside of the waist attachment, and a cable attached to the hand rail and passing under the damper.

40. The interface of claim 37, wherein the base comprises a movement system.

41. The interface of claim 40, wherein the base movement system comprises wheels.

42. The interface of claim 40, wherein the base movement system comprises a pivot.

43. The interface of claim 40, further comprising a steering system.

44. The interface of claim 1, further comprising a controller coupled to the motors and at least one sensor coupled to the controller, wherein:

the sensor is responsive to a positional change or a force exerted on the subject attachment module to produce a signal indicative of such positional change or force; and the controller is responsive to the signal produced by the sensor to produce one or more signals to one or more of the motors to exert a torque on or to cause a displacement of the subject attachment module.

45. The interface of claim 44, wherein:

the sensor is responsive to a positional change exerted on the subject attachment module to produce a signal indicative of such positional change; and the controller is responsive to the positional signal produced by the sensor to produce one or more signals to one or more of the motors to exert a torque on the subject attachment module.

46. The interface of claim 44, wherein:

the sensor is responsive to a force exerted on the subject attachment module to produce a signal indicative of such force; and the controller is responsive to the force signal produced by the sensor to produce a signal to one or more of the motors to cause a displacement of the subject attachment module.

47. The interface of claim 44, wherein:

the interface comprises at least two sensors;

one of the sensors is responsive to a positional change exerted on the subject attachment module to produce a signal indicative of such positional change;

one of the sensors is responsive to a force exerted on the subject attachment module to produce a signal indicative of such force;

the controller is responsive to the positional signal and to the force signal to produce one or more signals to one or more of the motors to exert a torque on or to cause a displacement of the subject attachment module.

48. The interface of claim 44, wherein the mechanical impedance or mechanical admittance of the interface is substantially determined by the combined actions of the controller, motors and sensors.

49. A method comprising:

attaching a subject to the subject attachment module of the pelvis interface defined by claim 1; and actuating at least one motor to impart a force or a torque to the arm assembly, thereby providing assistance, resistance, and/or perturbation to a pelvis motion by the subject.

50. The method of claim 49, further comprising attaching the subject to an ankle interface and actuating the ankle interface.

51. The method of claim 49, further comprising administering to the subject a drug or biological.

* * * * *